US006130657A

United States Patent [19]

Kurokawa et al.

[11] Patent Number: 6,130,657

[45] Date of Patent: Oct. 10, 2000

[54] LIQUID CRYSTAL DISPLAY DEVICE

[75] Inventors: Kazunari Kurokawa, Mobara; Noboru Kataoka, Ohami-Shirasato-machi; Hiroshi Watanabe; Hideaki Abe, both of Mobara, all of Japan

[73] Assignees: Hitachi, Ltd., Tokyo; Hitachi Device Engineering Co., Ltd., Chiba-ken, both of Japan

[21] Appl. No.: 09/008,289

[22] Filed: Jan. 16, 1998

[30] Foreign Application Priority Data

Feb. 7, 1997 [JP] Japan ..... 9-024789

[51] Int. Cl.[7] ..... G09G 3/36

[52] U.S. Cl. ..... 345/100; 345/99

[58] Field of Search ..... 345/97, 98, 99, 345/100, 101, 104

[56] References Cited

U.S. PATENT DOCUMENTS

| | | | |
|---|---|---|---|
| 5,103,218 | 4/1992 | Takeda | 345/100 |
| 5,192,945 | 3/1993 | Kusada | 345/100 |
| 5,602,561 | 2/1997 | Kawaguchi et al. | 345/100 |
| 5,726,677 | 3/1998 | Imamura | 345/99 |

*Primary Examiner*—Vijay Shankar
*Attorney, Agent, or Firm*—Antonelli, Terry, Stout & Kraus, LLP

[57] ABSTRACT

Internal shift registers, bit latch circuits, line latch circuits and output circuits are divided in units of an arbitrary number of outputs, and the data and clock signals to be transferred to their block are likewise divided. A standby function is given in a unit of the divisions, so that only a circuit for executing a data latch function is operated to lower the power consumption.

6 Claims, 14 Drawing Sheets

LIQUID CRYSTAL DISPLAY DEVICE

BACKGROUND OF THE INVENTION

The present invention relates to a liquid crystal display device and, more particularly, to a technique effective in lowering the power consumption of a liquid crystal display device to be incorporated in a portable information terminal or the like.

An STN (Super Twisted Nematic) type simple matrix liquid crystal display device has been widely used as a display device for a notebook personal computer or the like. FIG. 5 is a schematic block diagram showing a typical example of the construction of such an STN type simple matrix liquid crystal display device. In FIG. 5, reference numeral 101 designates a display control unit, reference numeral 102 designates a power supply circuit, and symbol LCD denotes a liquid crystal display panel.

The liquid crystal display panel LCD is equipped with a pair of glass substrates mutually opposed and arranged on either side of a liquid crystal. On the face of one glass substrate on the liquid crystal side, there are formed m common electrodes (or scanning lines) which extend in an X-direction, are juxtaposed in a Y-direction and are connected with corresponding common drivers (IC-C 1 to IC-C5). On the face of the other glass substrate on the liquid crystal side, there are formed n segment electrodes (data lines) which extend in an X-direction, are juxtaposed in an X-direction and are vertically grouped into two groups. These n segment electrodes of two groups are connected with either the upper corresponding segment drivers (IC-U1 to IC-Un) or the lower corresponding segment drivers (IC-L1 to IC-Ln). The intersections between the segment electrodes and the common electrodes constitute pixel regions, the pixels of which are driven by applying drive voltages from the upper segment drivers (IC-U1 to IC-Un), the lower segment drivers (IC-L1 to IC-Ln) and the common drivers (IC-C1 to IC-C5) to the segment electrodes and the common electrodes.

In FIG. 5, the liquid crystal panel control unit 101 controls the segment drivers (IC-U1 to IC-Un and IC-L1 to IC-Ln) and the common drivers (IC-C1 to IC-C5) on the basis of display control signals, transferred from a host computer or the like, and the display data. The power supply circuit 102 generates data signal line drive voltages VH, VM and VL, scanning line signal drive voltages VxH, VxL, Vcc and GND and feeds the voltages VH, VM, VL, Vcc and GND to the segment drivers (IC-U1 to IC-Ln) and the voltages VxH, VM, VxL, Vcc and GND to the common drivers (IC-C1 to IC-C5). In a simple matrix type liquid crystal display device, it is known to use a so-called current-alternating drive method, in which the drive voltages to be applied to the segment electrodes and the common electrodes are inverted for a predetermined period so that a DC voltage will not be applied to the liquid crystals.

FIG. 6 is a diagram for explaining one example of the data signal line drive voltages to be applied to the segment electrodes of the liquid crystal panel LCD shown in FIG. 5, and the scanning line signal drive voltages to be applied to the common electrodes. In the example shown in FIG. 6, when the current-alternating signal M is at a high level, the drive voltage VL is fed to the segment electrodes of display data "1" from the power supply circuit 102, and the drive voltage VH is fed and applied to the segment electrodes of data "0" from the power supply circuit 102. Likewise, when the current-alternating signal M is at a low level, the drive voltage VxH to be fed from the power supply circuit 102 is applied to the selected common electrodes. When the current-alternating signal M is at the high level, the drive voltage VxL to be fed from the power supply circuit 102 is applied to the selected common electrodes. Whether the current-alternating signal M is at the high or low level, the drive voltage VM to be fed from the power supply circuit 102 is applied to the nonselected common electrodes.

FIG. 3 is a block diagram of the segment driver of the display device shown in FIG. 5. The segment driver shown in FIG. 3 is constructed of a shift register circuit 301, a bit latch circuit 302, a line latch circuit 303, an output circuit 304 and a random logic circuit 310. Here, this random logic circuit 310 is equipped with a standby circuit 307 for bringing one segment driver into a standby state when no data latch is required. Numeral 308 designates an EIO1 circuit, and numeral 309 designates an EIO2 circuit. These EIO1 and EIO2 circuits receive a carry signal from the segment driver of the preceding stage, and output internal carry signals CAR1 and CAR2 to the shift register circuit 301 and a standby signal STBY to the standby circuit 307, as well as a carry signal to the next-stage segment driver. FIG. 3 shows a segment driver having two hundred and forty outputs, and symbols Y1 to Y240 designate the output terminals.

Now, the data fetching and outputting operations of the segment driver shown in FIG. 3 will be described. In the random logic circuit 310, a display data latching clock signal CL2 inputted from the display control unit 101 is converted into an internal data latching clock signal SCL2. On the basis of this internal data latching clock signal SCL2, the shift register circuit 301 generates a data fetching signal for latching data in the bit latch circuit 302 and outputs it to the bit latch circuit 302. Moreover, 4-bit display data DATA inputted from the display control unit 101 is also converted into internal data SD. The internal data latching clock signal SCL2 and the internal data SD is fixed to the low level when in the standby state. The bit latch circuit 302 latches the internal data SD on the basis of the data fetching signal inputted from the shift register 301.

On the basis of an output timing controlling line clock signal CL1, although not shown, the line latch circuit 303 latches the display data fetched by all the bit latch circuits 302, and outputs this data to the output circuit 304. The output circuit 304 converts the voltage level of the display data inputted from the line latch circuit 303 to a high voltage level, and performs the aforementioned current-alternating operations from the data converted into the high-voltage level and the current-alternating signal M so as to select one of the three-level data signal line drive voltages fed from the power supply circuit 102, thereby to output the selected three-level data signal line drive voltage to the segment electrodes (data signal lines).

FIG. 7 shows an operating state diagram of the segment drivers for each period when one-line of data is written. In FIG. 7, the display data for one line juxtaposed in the X-direction is outputted from the n segment drivers. In this case, the segment drivers (IC-U1 to IC-Un and IC-L1 to IC-Ln) start operating according to a later-described carry signal (bar EIO1 or bar EIO2) to fetch display data at that time. The segment drivers (IC-U1 to IC-Un, and IC-L1 to IC-Ln) to which the carry signal is not inputted are held in a standby state in which their internal operations are stopped, because they need not fetch the display data. The segment drivers (IC-U1 to IC-Un and IC-L1 to IC-Ln) having finished the fetching of the display data stop their internal operations to take up the standby state. As a result, in the prior art, the segment drivers (IC-U1 to IC-Un and ICL1 to IC-Ln) are brought one by one into the standby state to lower the power consumption.

FIG. 4 is a timing chart for the segment drivers and shows the carry signal (bar EIO1 or bar EIO2) and the operations in the segment drivers. FIG. 4 shows an example in which the data fetching signals are shifted from the left to the right in the shift register 301 shown in FIG. 3. As a result, the carry signal bar EIO1 is inputted, and the carry signal bar EIO2 is outputted and inputted to the carry input of the next-stage segment drivers (IC-U1 to IC-Un and IC-L1 to IC-Ln). The inside of the segment driver is divided into internal circuits, as shown in FIG. 3, so that the operations are started in all the circuits simultaneously with the input of the carry signal bar EIO1 and all lines of the internal data bus SD and the data latching clock signal SCL2 in the segment drivers are activated.

In the prior art thus far described, the standby state is controlled only in units of one segment driver, so that the control is insufficient to lower the power consumption.

SUMMARY OF THE INVENTION

According to one aspect of the invention, the shift registers, the bit latch circuits, the line latch circuits and the output circuits of the segment drivers are divided into blocks for an arbitrary number of outputs, and the standby function is applied to each block, so that the circuits are stopped, other than for the operation of latching the data.

According to another aspect of the invention, the internal data buses and the internal data latching clock signals are divided in units of blocks, and the internal data buses and the internal data latching clock signals thus divided are given the standby function, so that the divided internal buses and internal data latching clock signals are stopped while the blocks are being stopped.

According to still another aspect of the invention, the internal data buses and the internal data latching clock signals are divided in units of blocks, and the internal data buses and the internal data latching clock signals thus divided are given the standby function so that the start signals from the block of the preceding stage are used for starting the operations of the blocks, whereas the stop signals from the blocks in operation are used for stopping the operations of the blocks.

According to the constructions described above, the standby function is not made in units of one liquid crystal drive unit, but is finely divided internally in a drive unit, so that the power consumption is lowered by the fine divisions.

DESCRIPTION OF THE PREFERRED EMBODIMENTS

Figure 1:
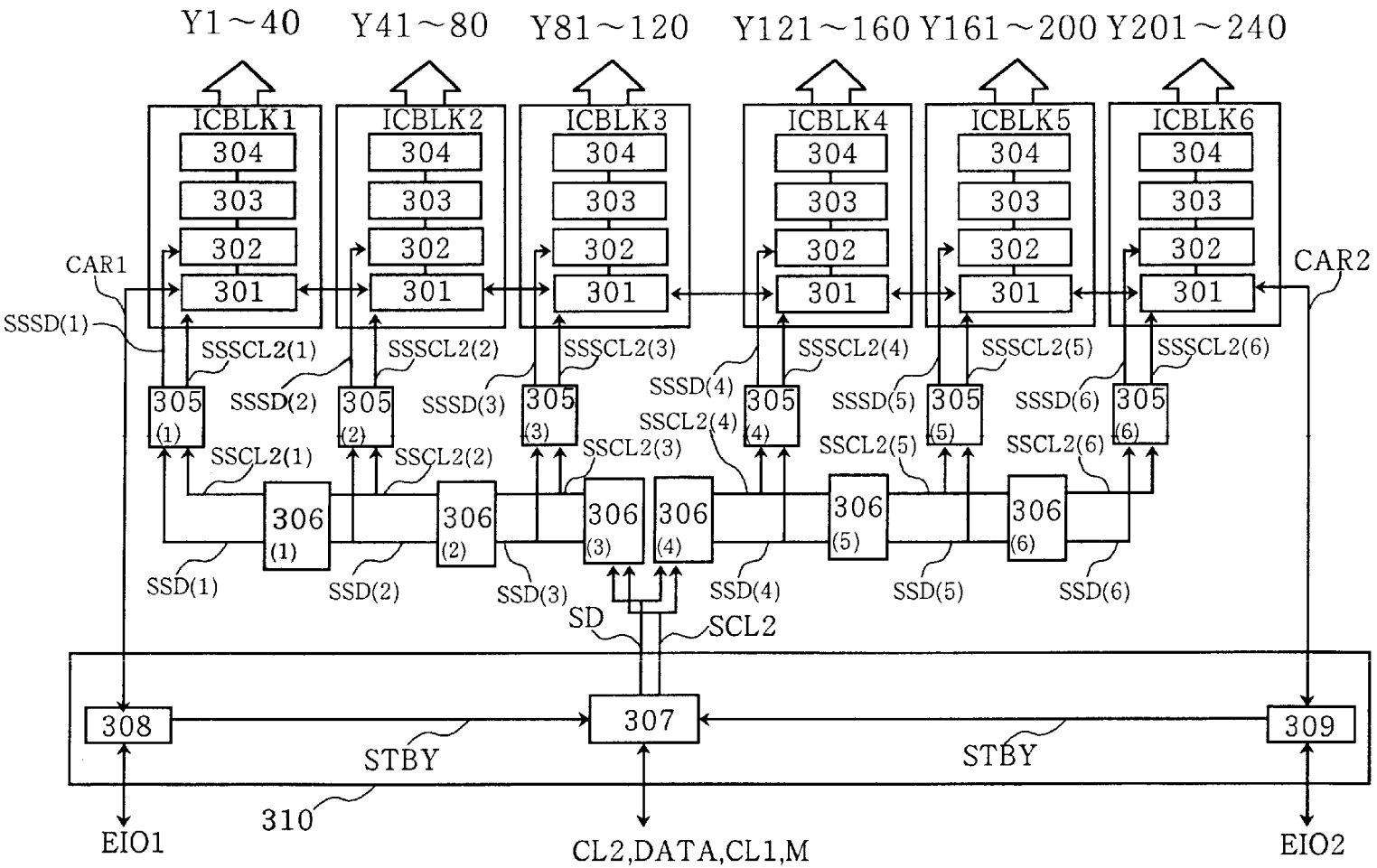
FIG. 1 is a block diagram of a liquid crystal drive device forming one embodiment according to the invention.

FIG. 1 is a block diagram of a segment driver according to one embodiment of the invention. Shift registers 301, bit latch circuits 302, line latch circuits 303 and output circuits 304 are divided into blocks for every forty outputs, and for each block a standby circuit 305 is provided. Here, symbol SSSD designates data buses in the blocks, and symbol SSSCL2 designates data latching clock signal lines in the blocks. Moreover, internal data buses SSD and internal clock signal lines SSCL2 are also divided into blocks and each block is provided with a standby circuit 306 for respective internal clock signal lines SSCL2.

As in the prior art, moreover, a random logic circuit 310 is provided with a standby circuit 307 for effecting a standby state for each segment driver. The standby circuit 307 and the standby circuits 306 are connected through an internal data bus SD and an internal clock signal line SCL2. To the random logic circuit 310, there are inputted an output timing controlling line clock signal CL1, 4-bit display data DATA, a display data latching clock signal CL2, a current-alternating signal M and carry signals EIO1 and EIO2.

Figure 2:
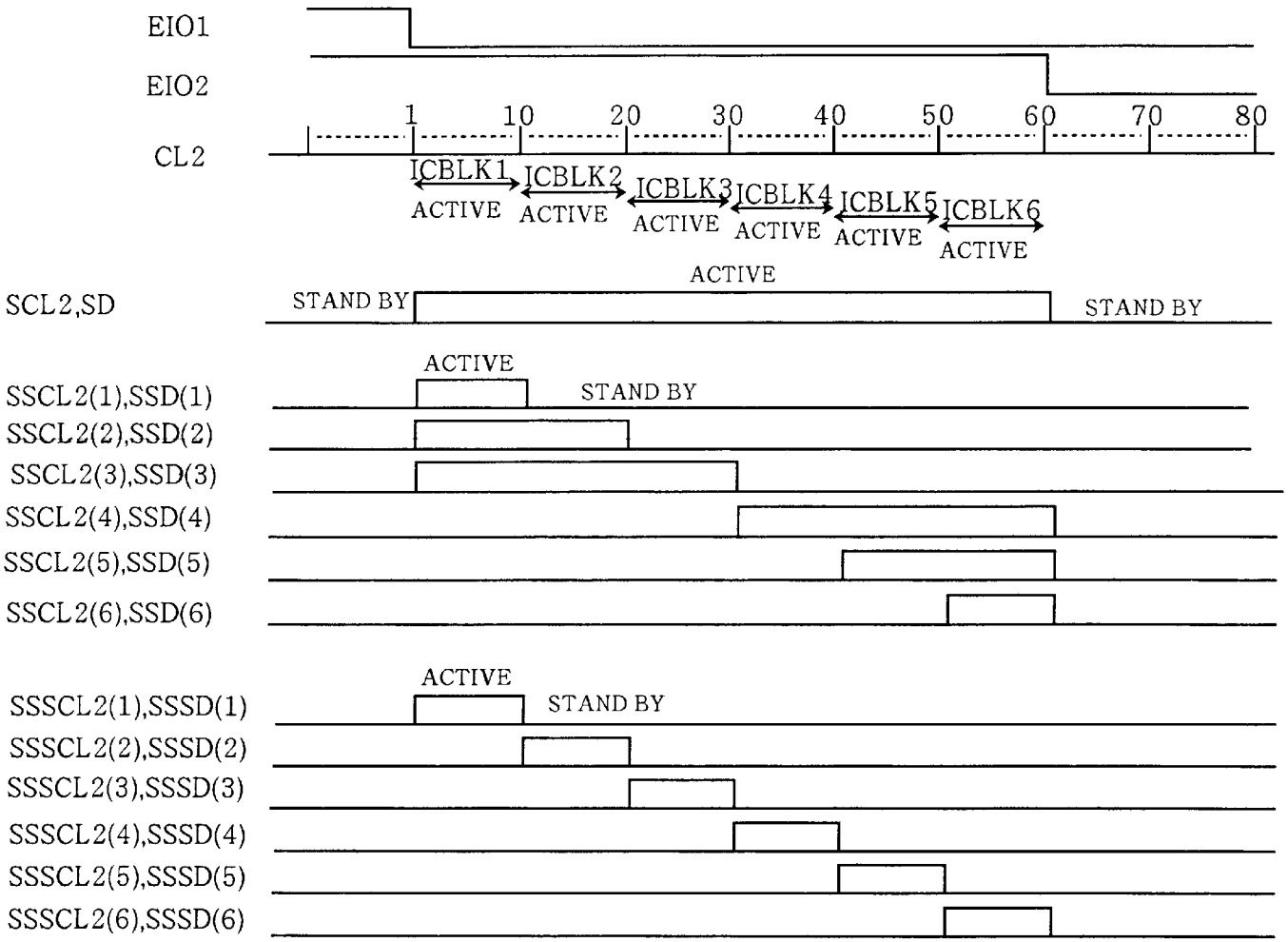
FIG. 2 is a timing chart of the liquid crystal drive device of FIG. 1, according to the invention.
Figure 3:
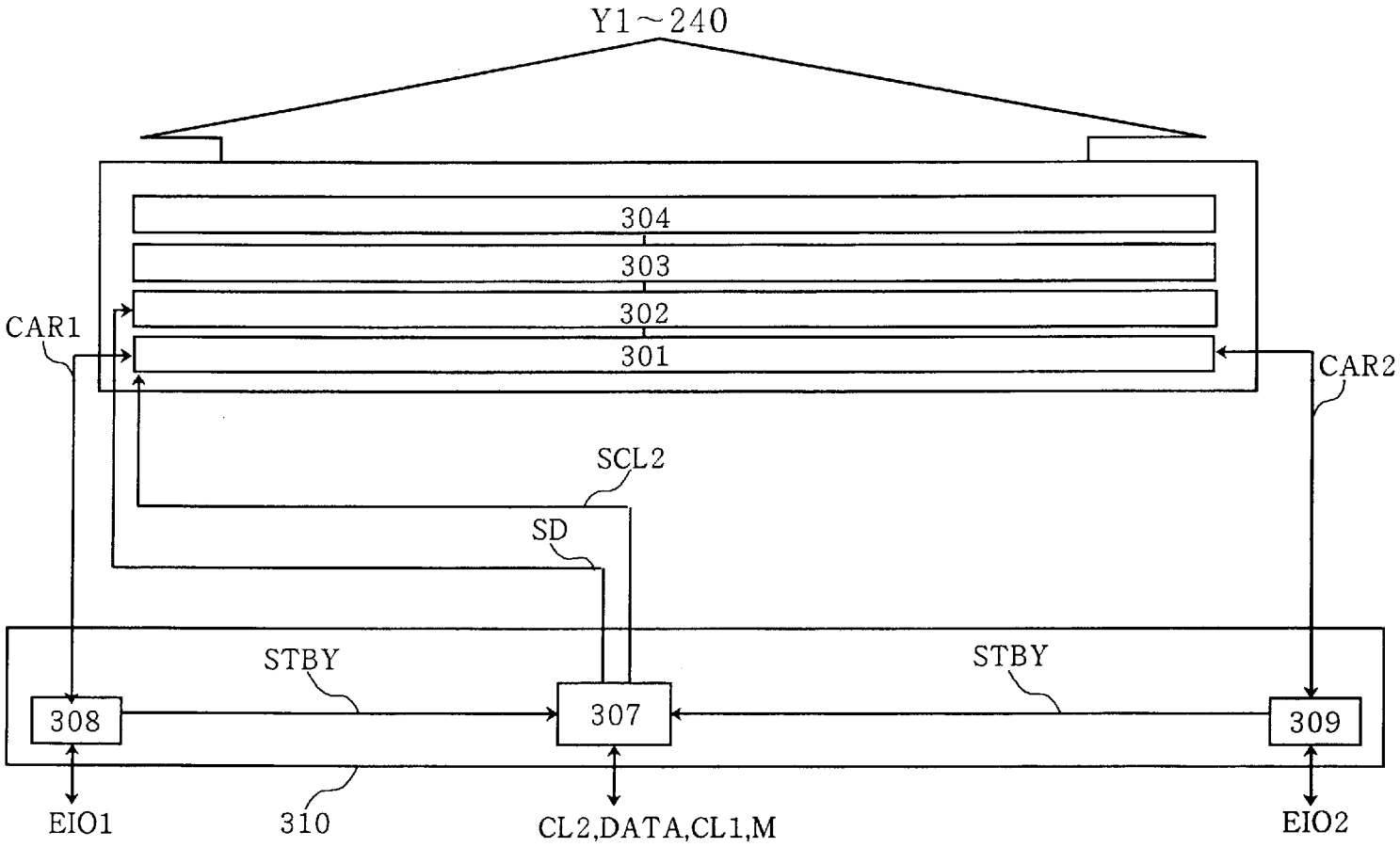
FIG. 3 is a block diagram of a liquid crystal drive device of the prior art.
Figure 4:
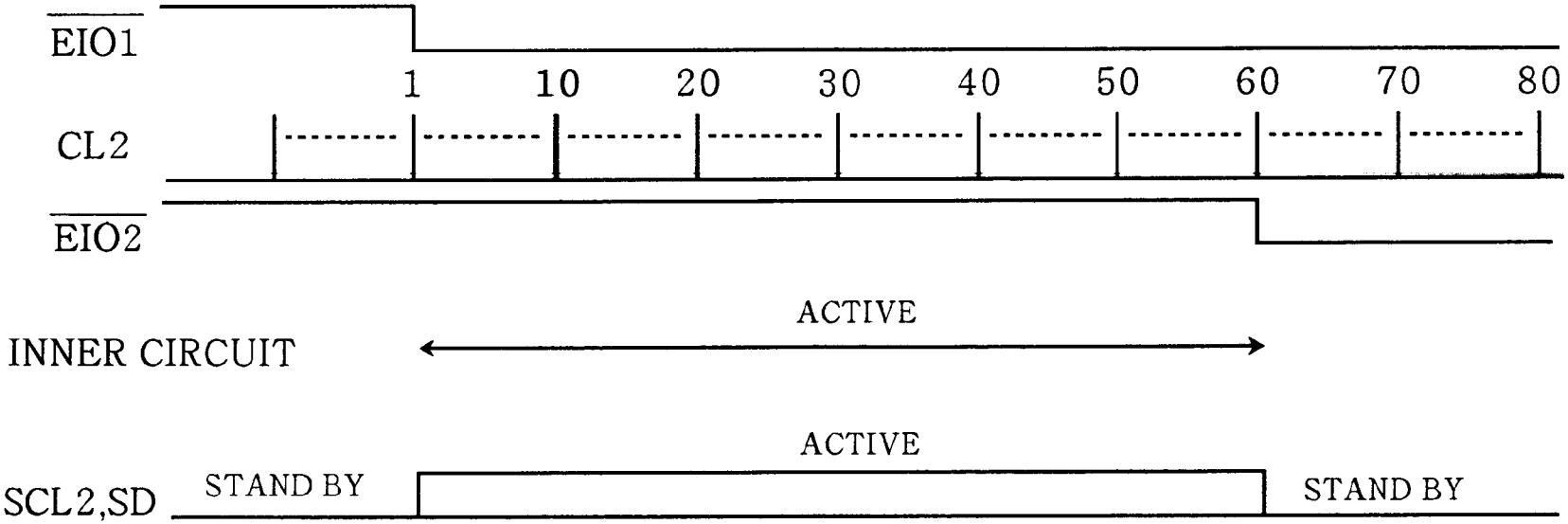
FIG. 4 is a timing chart of the liquid crystal drive device of FIG. 3.
Figure 5:
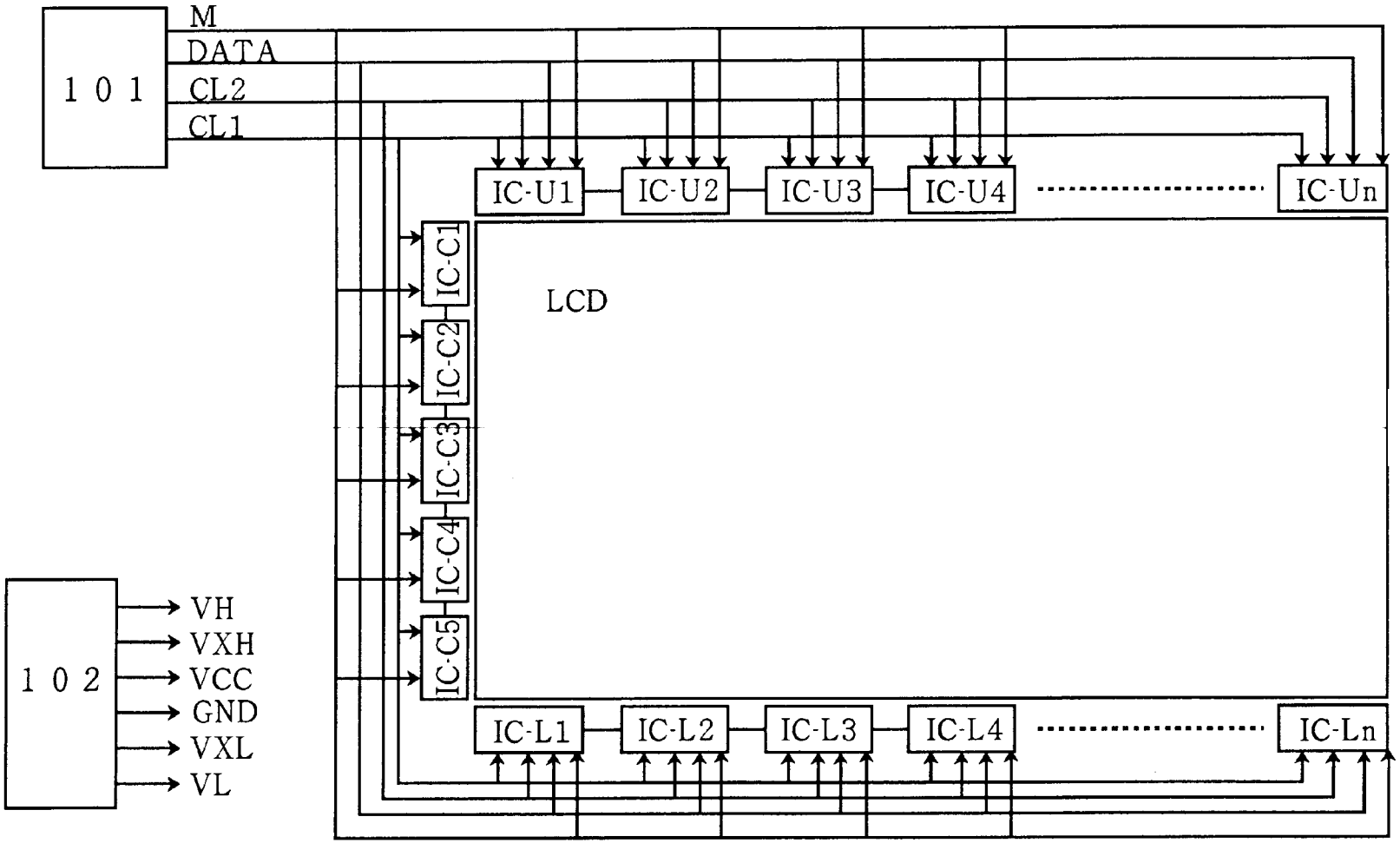
FIG. 5 is a block diagram showing a schematic construction of the liquid crystal drive device of the prior art.
Figure 6:
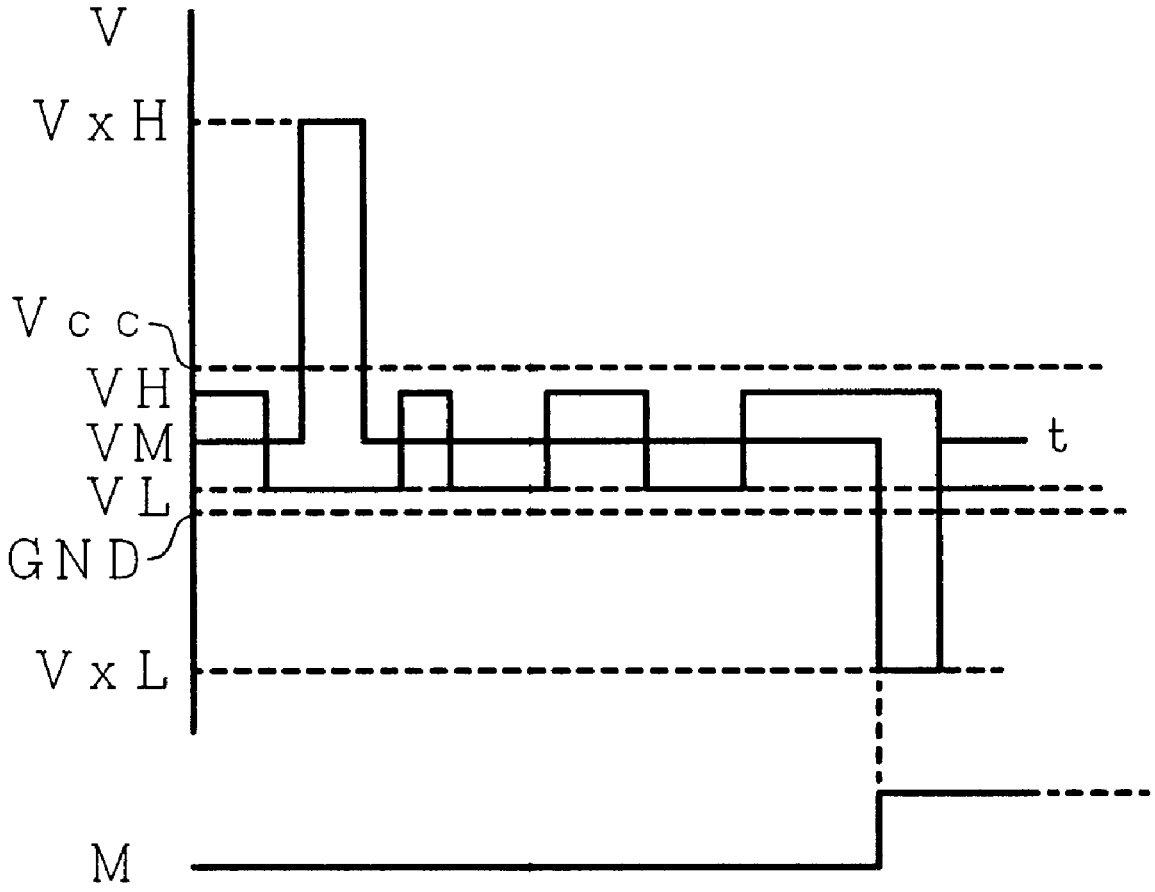
FIG. 6 is a voltage waveform diagram showing drive voltages of the liquid crystal drive device.
Figure 7:
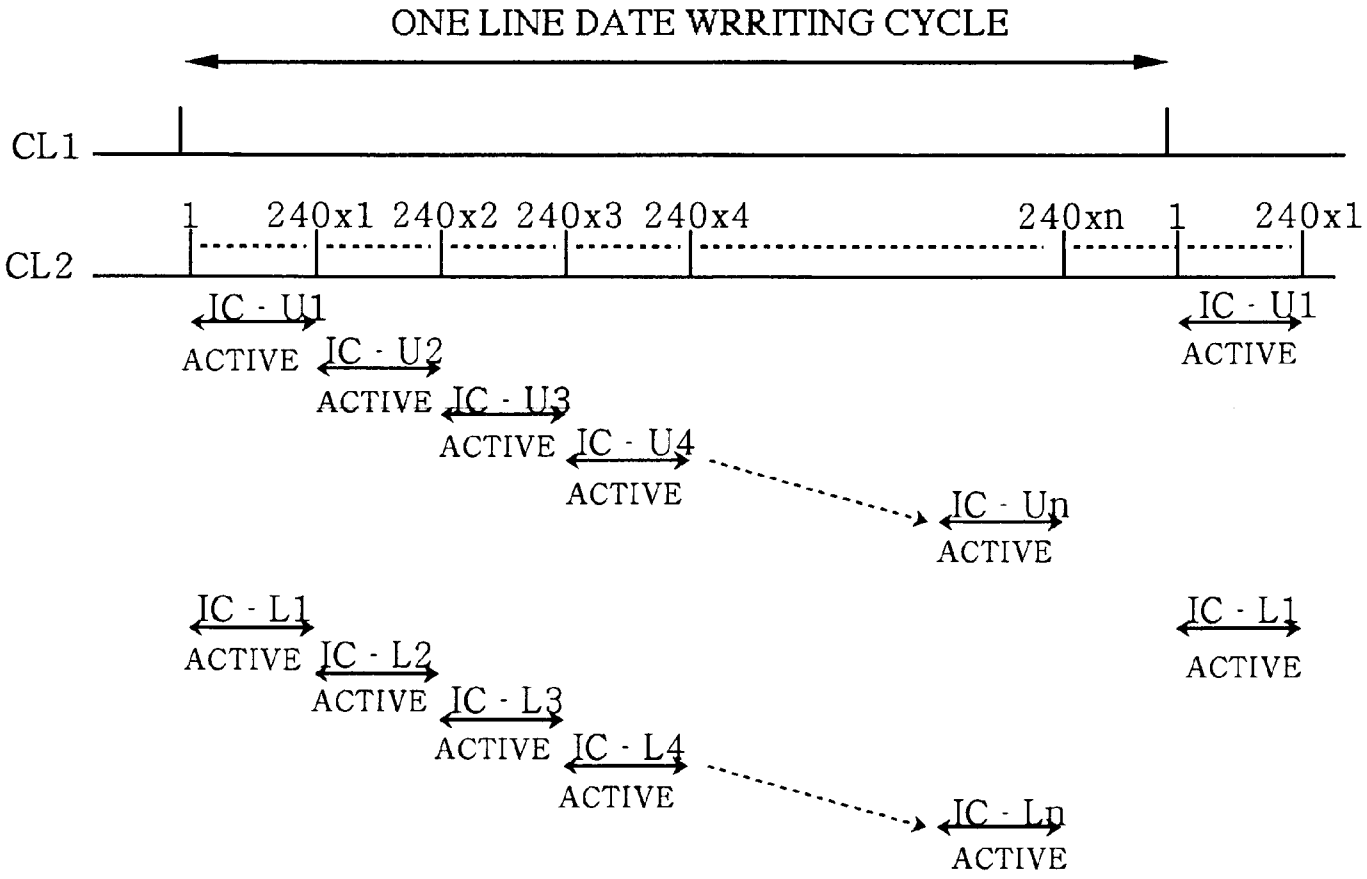
FIG. 7 is a timing chart showing the operating state of the liquid crystal drive device of the prior art.

FIG. 2 shows a timing chart for the blocks shown in FIG. 1. For easy understanding, the rightward shift (Y1→Y240) will be described, but the same description also holds for the leftward shift (Y240→Y1). The inside of the segment driver is entirely in the standby (or stopping) state until the carry signal (i.e., bar EIO1) from the liquid crystal drive device at the preceding stage is inputted.

When the carry signal (bar EIO1) is inputted, the internal logic circuit, the internal data bus SD and the internal clock signal SCL2 start operating. Moreover, the standby state of the standby circuits 306(1), 306(2) and 306(3) is canceled to activate the internal data buses SSD(1), SSD(2) and SSD(3), and the internal clock signal lines SSCL2(1), SSCL2(2) and SSCL2(3). Still moreover, the standby state of the standby circuit 305(1) is canceled to activate the block data bus SSSD(1) and the block clock signal line SSSCL(2) in a block ICBLK1, so that the display data DATA to be inputted from a display control unit 101 is latched in the latch circuits 302 of the block ICBLK1.

Here, the display data DATA is fed through the 4-bit data bus, and a 1-bit data is latched in one output. In order to latch the data of the forty outputs, therefore, it takes ten pulses of the data latching clock signal CL2. The block ICBLK1 transfers the carry, when it latches the data of the outputs Y1 to Y40, to the next-stage block, and the standby circuit 305(1) comes into a standby state and fixes the block data bus SSSD(1) and the clock signal line SSSCL2(1) at a low level to stop the circuits in the block. Moreover, the standby circuit 306(1) is also brought into a standby state to fix the internal data bus SSD(1) and the internal clock signal line SSCL2(1) at the low level and to bring them into stopped states.

Next, in response to the carry input from the block ICBLK1, the standby circuit 305(2) comes from a standby state into an operating state to feed the block data bus SSSD(2) and the block clock signal line SSSCL2(2) to a block ICBLK2, and the display data is latched. The block ICBLK2 transfers the carry, when it latches the data of the outputs Y41 to Y80, to the next-stage block. Moreover, the standby circuit 305(2) comes into a standby state to fix the block data bus SSSD(2) and the block clock signal line SSSCL2(2) at the low level to stop the circuits in the block. Moreover, the standby circuit 306(2) is also brought into the standby state to fix the internal data bus SSD(2) and the internal clock signal line SSCL2(2) at the low level and to bring them into stopped states. The block ICBLK3 operates in a similar manner.

Next, in response to the carry input from the block ICBLK3, the internal data bus SSD(4), the internal clock signal SSCL2(4) and a block ICBLK4 come from the standby state into the operating state, so that the block ICBLK4 latches the display data. The block ICBLK4 transfers the carry, when it latches the data of the outputs Y12 1 to Y160, to the next-stage block, and comes into the standby state to fix the block data bus SSSD(4) and the block clock signal line SSSCL2(4) at the low level and to stop the internal circuits. Here, the internal data bus SSD(4) and the internal clock signal line SSCL2(4) hold the operating states to transfer the data and clock signals to a block ICBLK(5).

In response to the carry input from the block ICBLK4, the internal data bus SSD(5), the internal clock signal line SSCL2(5) and a block ICBLK4 come from the standby state into operating state, so that the block ICBLK5 latches the display data. The block ICBLK5 transfers the carry, when it latches the data of the outputs Y16 1 to Y200, to the next-stage block, and comes into the standby state to fix the block data bus SSSD(5) and the block clock signal line SSSCL2(5) at the low level and to stop the internal circuits. Here, the internal data bus SSD(5) and the internal clock signal line SSCL2(5) hold the operating states similar to the preceding stage.

A block ICBLK6 also operates in a similar manner. The block ICBLK 6 outputs a carry EIO2, when it latches the outputs Y20 1 to Y240, to a next-stage segment driver, and the standby circuit 307 fixes the internal data bus SD and the internal clock signal line SCL2 at the low level to bring the entire segment driver into the standby state and to stop the internal circuits.

As described above, the circuit to be operated can be made smaller than that of the prior art, so that the power consumption can be lowered. Liquid crystal drive devices have a tendency to have a smaller wiring width and a thinner stacked wirings insulating film, so that the wirings have larger capacitances and higher resistances. The power to be consumed by the wirings cannot be neglected, and a low power consumption can be achieved by stopping the signals as in the construction described above.

Figure 8:
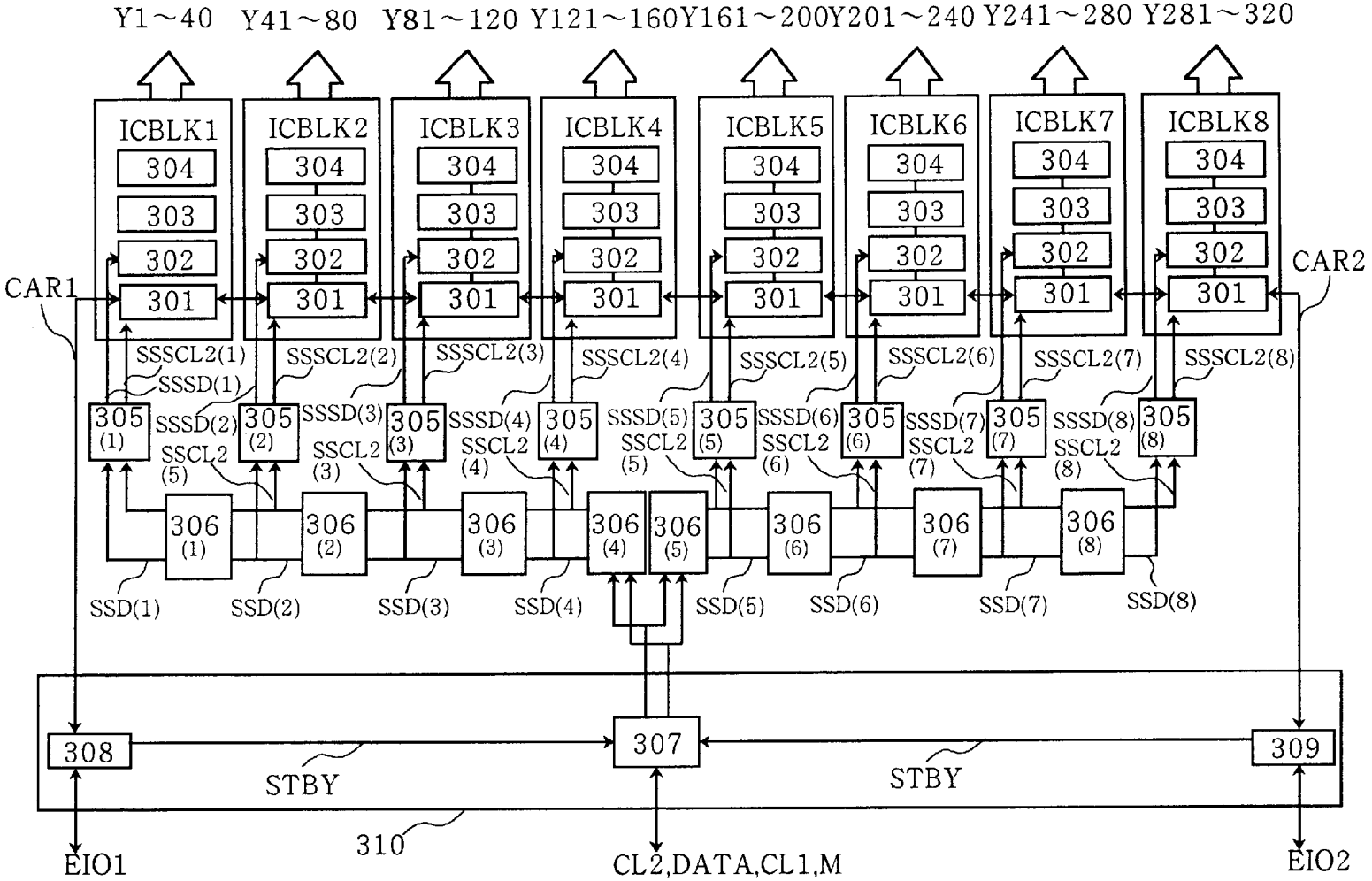
FIG. 8 is a block diagram of a liquid crystal drive device representing another embodiment according to the invention.
Figure 9:
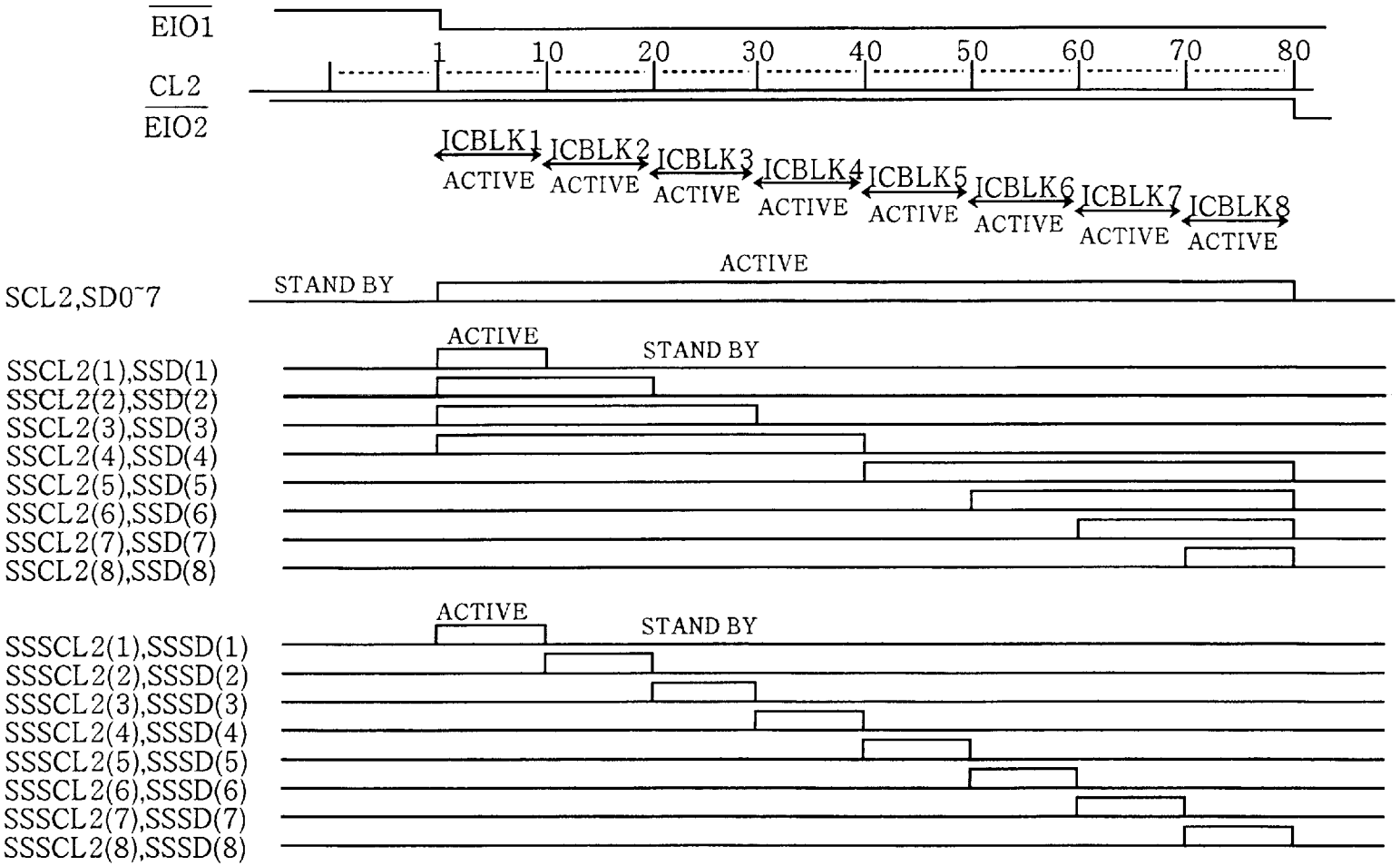
FIG. 9 is a timing chart of the liquid crystal drive device of FIG. 8, according to the invention.

FIG. 8 is a circuit diagram for three hundred and twenty outputs, and FIG. 9 is a timing chart for the circuit. The operations are similar to those of the aforementioned case of two hundred and forty outputs. When the carry signal (bar EIO1) is inputted from the liquid crystal drive device of the preceding stage, the standby states of internal data buses SSD(1), SSD(2), SSD(3) and SSD(4) are canceled. In the case of three hundred and twenty outputs, the standby states of the blocks ICBLK1 to ICBLK4 for the outputs Y1 to Y160 are canceled, and the standby states of the other half of the internal data buses SSD(5), SSD(6), SSD(7) and SSD(8) are then canceled after the output Y160 is latched by the block ICBLK4.

Figure 10:
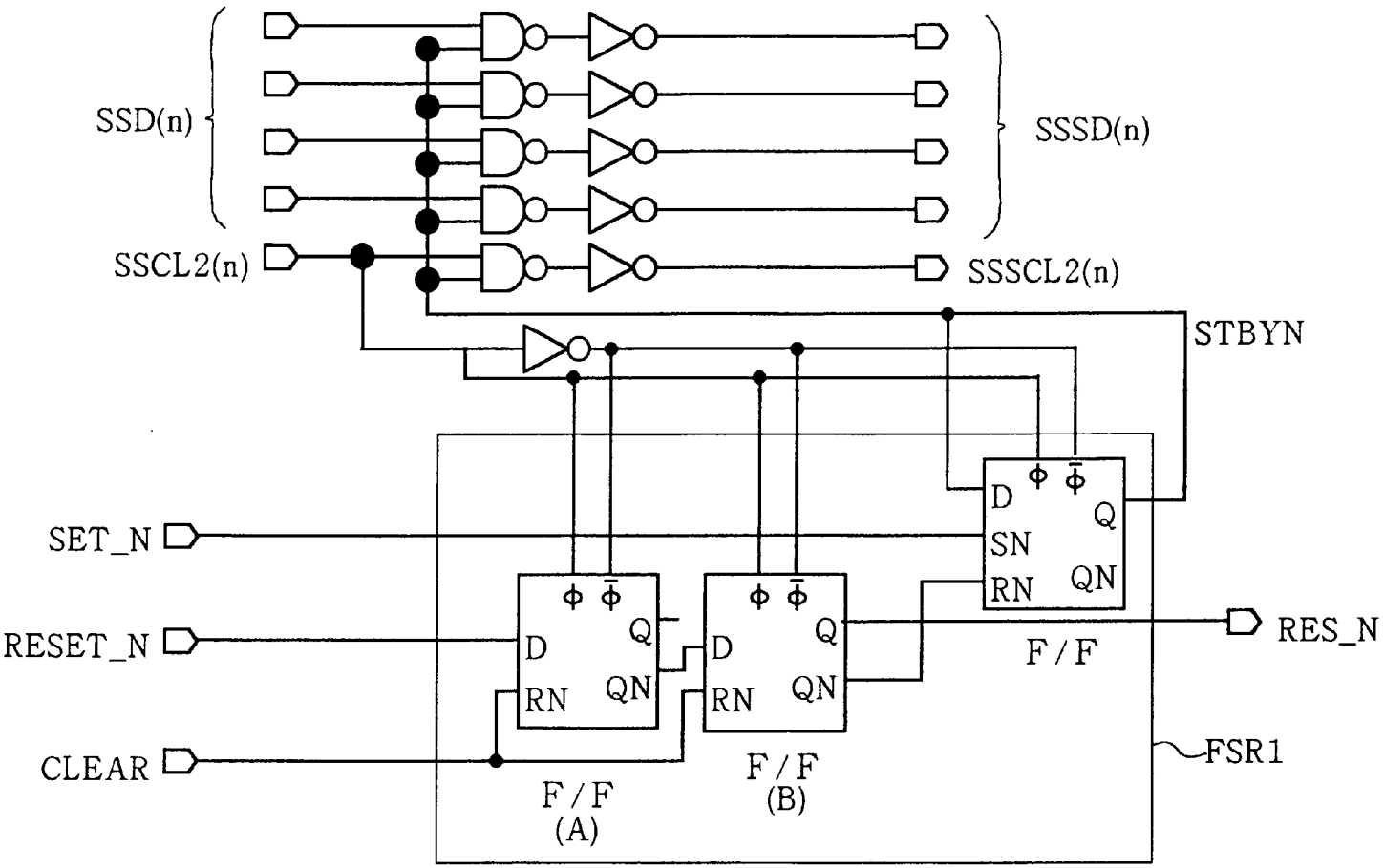
FIG. 10 is a circuit diagram of a standby circuit for use in the embodiment according to the invention.
Figure 11:
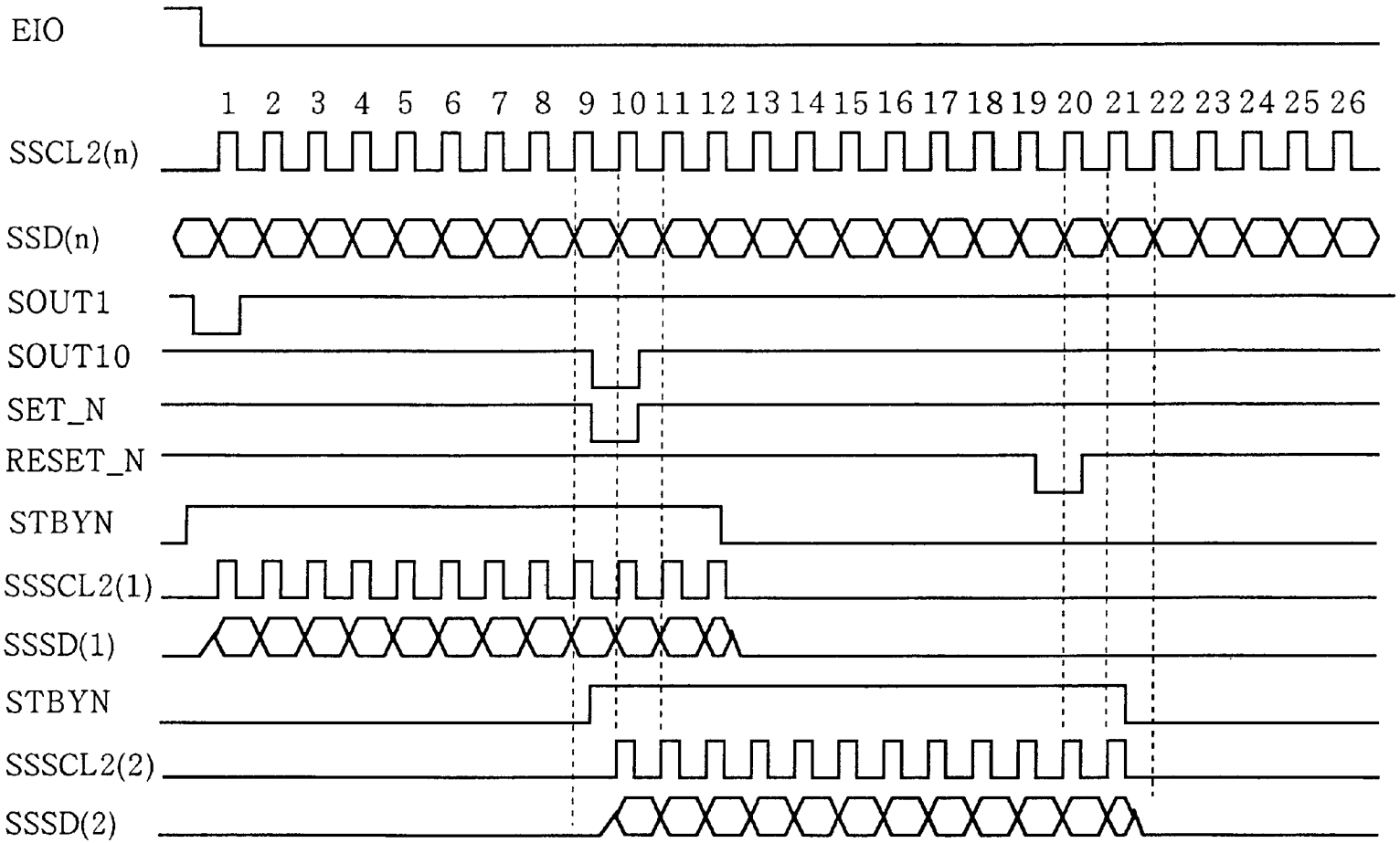
FIG. 11 is a timing chart of the standby circuit of FIG. 10, according to the invention.

Now, the operations of the standby circuits 305 and the standby circuits 306 in the case of a rightward shift (from Y1 to Y240) will be described. First, the standby operation in the block ICBLK2 of FIG. 1 will be described with reference to FIGS. 10 and 11. FIG. 10 is a circuit diagram of the standby circuit 305, and FIG. 11 is an operation timing chart of the standby circuit 305. In FIG. 11, symbol SOUT designates data fetching signals, outputted by the shift register circuits 301, of the latch circuits 302; symbol SOUT1 designates the first data fetching signal of the block ICBLK1; and symbol SOUT10 designates the last data fetching signal.

As shown in FIG. 10, the standby circuit 305 inputs at first the reset signal of a flip-flop circuit FSR1 to a signal line CLEAR and fixes the outputs of the block data bus SSSD and the block clock signal line SSSCL2 at the low level, so that it takes up the standby state. To cancel the standby state of the standby circuit 305, the data fetching signal SOUT from the shift register circuit 301 is used. As an example, the canceling of the standby state of the block ICBLK2 will be described.

In the block ICBLK1, as shown in FIG. 11, the data fetching signal SOUT10 is outputted at the time of fetching the data of the output Y40 into the latch circuit 302. The data fetching signal SOUT10 is inputted as the standby canceling signal of the block 1CBLK2 to a signal line SET_N of the standby circuit 305 shown in FIG. 10. When the signal line SET_N goes to the low level (the signal line SET_N is effective when at the low level), the flip-flop circuit FSR1 fixes a standby signal STBYN at a high level to output the internal data SSD and the internal clock signal SSCL2 to the block data bus SSSD and the block clock signal line SSSCL2, respectively.

In order to establish the standby state again, when the data of the output Y80 is fetched by the latch circuit 302, the data fetching signal SOUT is inputted as the carrier signal of the block ICBLK2 from the shift register circuit 30 1 of the block ICBLK2 to a RESET_M signal. When the carry signal RESET_N is inputted, the standby signal STBYN is fixed at the low level, and the outputs of the block data bus SSSD and the block clock signal line SSSCL2 are fixed at the low level, so that the block ICBLK2 comes into the standby state.

Thus, the standby state of the block clock signal SSSCL2 is canceled in advance for the data fetched in the latch circuit 302 by using the data fetching signal of the preceding-stage block, thereby improving the margin of the setup and hold times for latching the data. By using flip-flops F/F(A) and F/F(B), after two periods of the clock signal SSCL2 after the carry signal RESET_N is inputted, the block ICBLK2 takes up the standby state, so that the data to be read by the block ICBLK2 can be reliably fetched.

Figure 12:
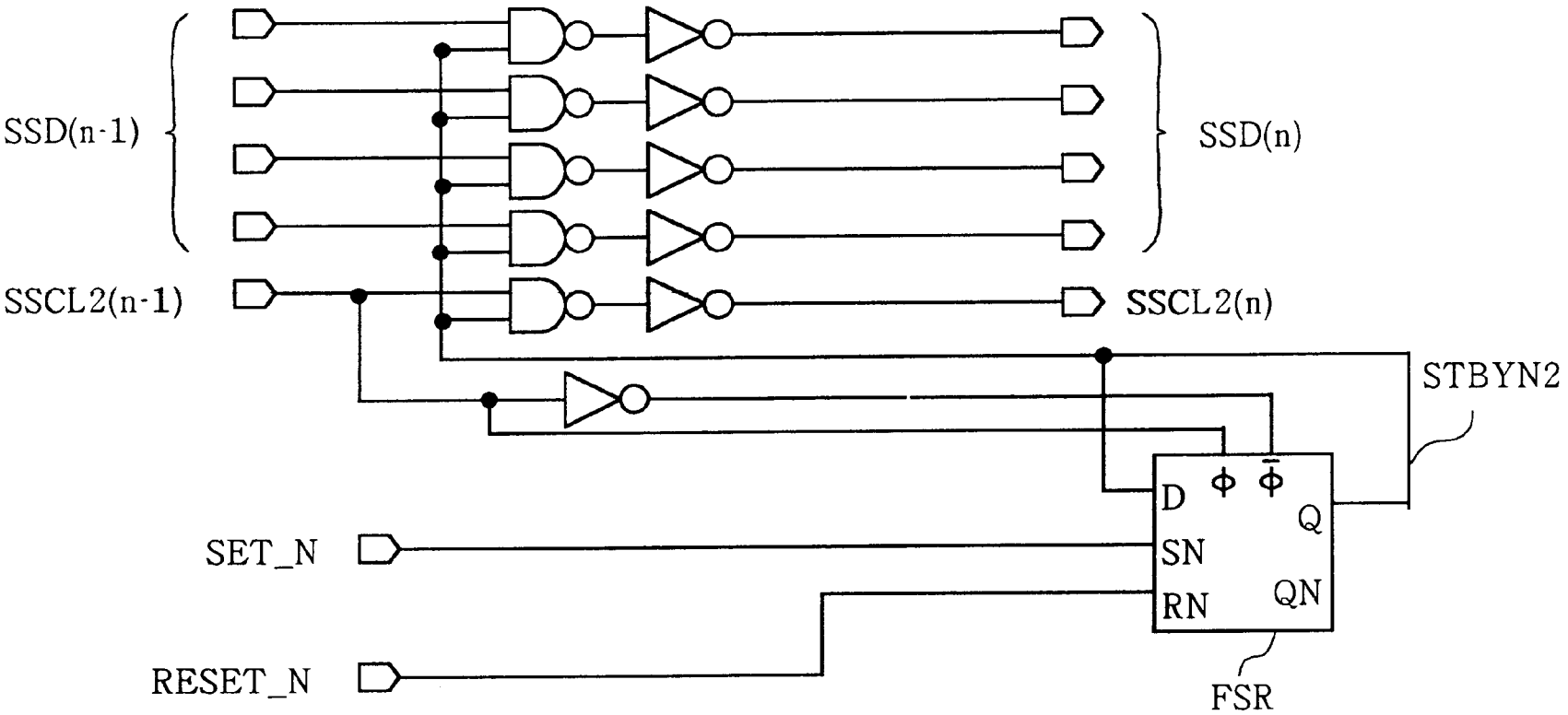
FIG. 12 is a circuit diagram of a standby circuit for use in the embodiment according to the invention.
Figure 13:
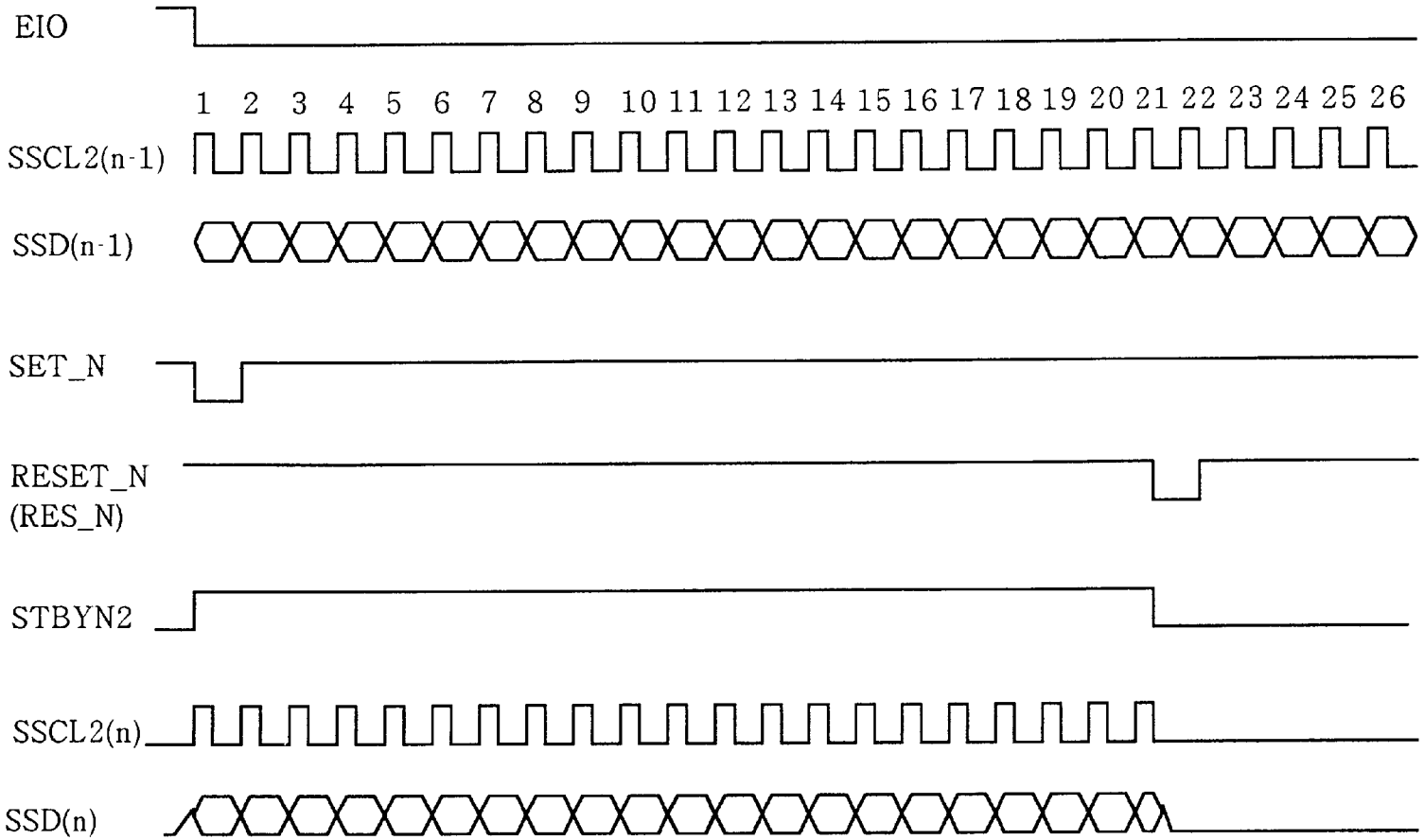
FIG. 13 is a timing chart of the standby circuit of FIG. 12, according to the invention.

FIG. 12 is a circuit diagram of the standby circuit 306. FIG. 13 is an operation timing chart of the standby circuit 306. The operation of the standby circuit 306 between the internal data buses SSD(2) and SSD(3) of FIG. 1 will be described with reference to FIGS. 12 and 13. When the standby circuit 306 is operated by the block ICBLK1 side, the SET_N signal inputs the reset signal (the aforementioned signal CLEAR) of the shift register. When the signal line SET_N is inputted, the flip-flop circuit FSR fixes the signal line STBYN2 at the high level and outputs the internal data SSD(3) and the internal clock signal line SSCL2(3) to the internal data bus SSD(2) and the internal clock signal SSCL2(2), respectively. The signal RESET_N inputs the RES_N signal generated by the standby circuit 305. When the RES_N signal is inputted, the standby signal STBYN2 is fixed at the low level, and the outputs of the internal data bus SSD(2) and the internal clock signal line SSCL2(2) are fixed at the low level, so that they come into the standby state.

Figure 14:
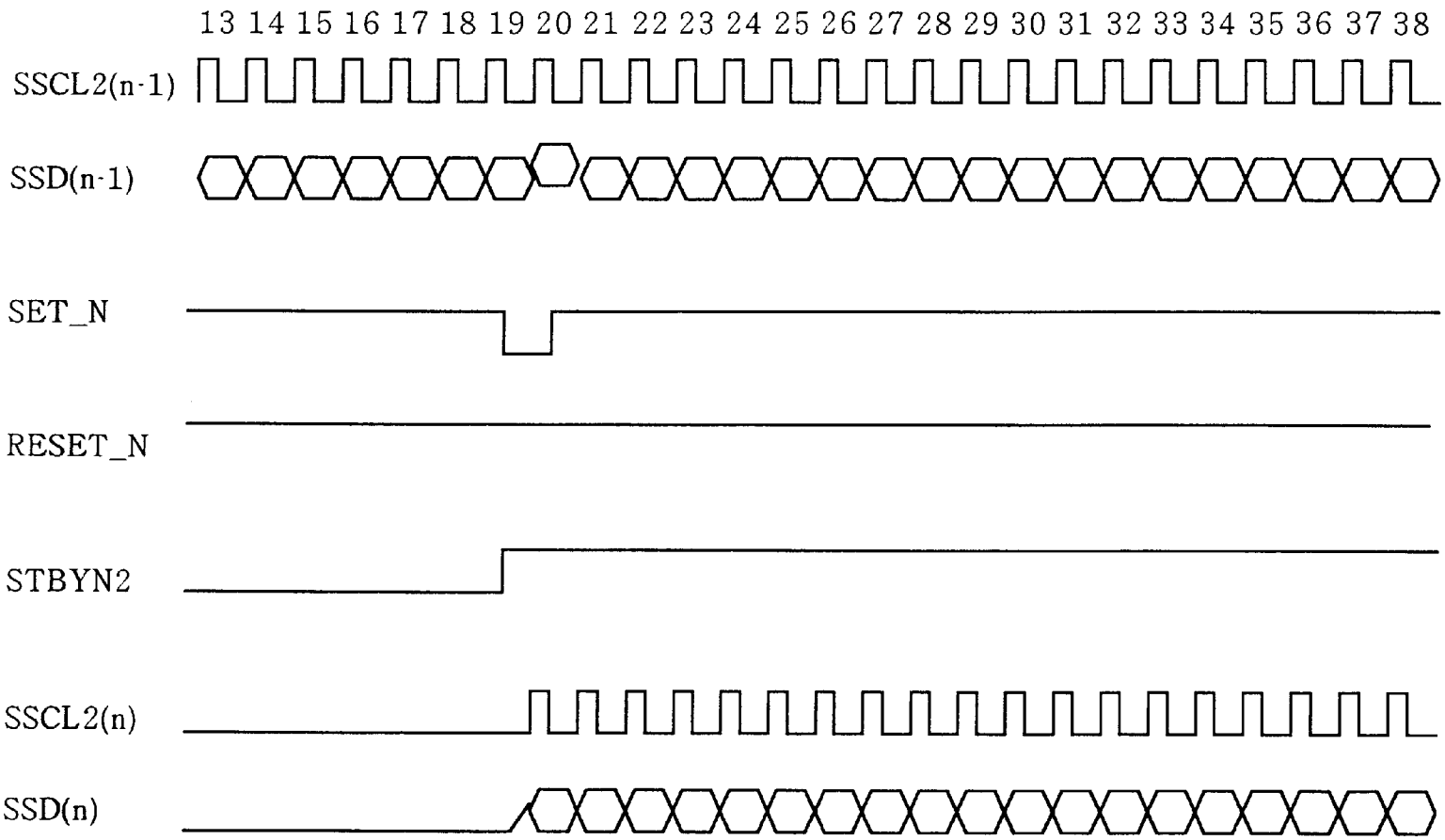
FIG. 14 is a timing chart of the standby circuit of FIG. 12, according to the invention.

Next, the operation of the standby circuit 306 between the internal data buses SSD(5) and SSD(6) of FIG. 1 will be described with reference to FIG. 14. The signal SET_N inputs thereto the carry signal of the final-stage shift register of the block ICBLK4. When the signal SET_N is inputted, the flip-flop circuit FSR fixes the standby signal STBYN2 at the high level to output the internal data SSD(5) and the clock signal SSCL2(5) to the internal data buses SSD(6) and SSCL2(6), respectively. The signal RESET_N inputs the reset signal (the aforementioned CLEAR) of the shift register. When the signal RESET_N is inputted, the standby signal STBYN2 is fixed at the low level, and the outputs of the internal data bus SSD(2) and the internal clock signal line SSCL2(2) are fixed at the low level, so that the standby state is established. When the data latch is completed to the last stage without any input of the reset signal (the aforementioned signal CLEAR) of the shift register, the entire chip comes into the standby state, but the internal data bus SD and the internal clock signal line SCL2 are fixed at the low level to establish the standby state.

Although, in the foregoing description, the bus is a 4-bit bus, any of an 8-bit bus, a 12-bit bus and so on can be used. Although the division of every forty outputs is adopted, the aforementioned object can be achieved as long as the number of divisions is an integral multiple of the value of the bus width.

According to the constructions thus far described, the standby function is not given in units of one segment driver, but is finely divided internally, so that the power consumption is reduced by the fine division.

Moreover, it is effective in reducing the power consumption of the liquid crystal drive device that the segment driver for driving the liquid crystal panel is made to consume less electric power.

What is claimed is:

1. A liquid crystal display device comprising:

a liquid crystal display element;

a liquid crystal drive unit for driving said liquid crystal display element, said liquid crystal drive unit having a shift register circuit divided into blocks in units of an output;

a standby circuit provided for each of said blocks;

a block data bus connected to at least a respective one of said blocks from said standby circuit; and an internal data bus connected to each standby circuit;

wherein said standby circuit stops a data signal from said internal data bus to said block data bus.

2. A liquid crystal display device of claim 1, wherein said internal data bus has an internal standby circuit, and said internal standby circuit stops a data signal of said internal data bus.

3. A liquid crystal display device comprising:

a liquid crystal display element;

a liquid crystal drive unit for driving said liquid crystal display element, said liquid crystal drive unit having a shift register circuit divided into blocks in units of an output;

a standby circuit provided for each of said blocks;

a block clock signal line connected to at least a respective one of said blocks from said standby circuit; and an internal clock signal line connected to each standby circuit;

wherein said standby circuit stops a clock signal from said internal clock signal line to said block clock signal line.

4. A liquid crystal display device comprising:

a liquid crystal display element;

a liquid crystal chive unit for driving said liquid crystal display element, said liquid crystal drive unit having a shift register circuit divided into blocks in units of an output;

a standby circuit provided for each of said blocks;

a block data bus connected to at least a respective one of said blocks from said standby circuit;

a block clock signal line connected to said block from said standby circuit;

an internal data bus connected to each standby circuit; and an internal clock signal line connected to each standby circuit;

wherein said standby circuit stops a data signal from said internal data bus to said block data bus, and stops a clock signal from said internal clock signal line to said block clock signal line.

5. A liquid crystal display device comprising:

a liquid crystal display element;

a liquid crystal drive unit for driving said liquid crystal display element, said liquid crystal drive unit having a shift register circuit divided into a first block and a second block;

a first standby circuit provided for said first block;

a second standby circuit provided for said second block;

a first block data bus connected to said first block from said first standby circuit;

a second block data bus connected to said second block from said second standby circuit;

a first block clock signal line connected to said first block from said first standby circuit;

a second block clock signal line connected to said second block from said second standby circuit; and a standby canceling signal line is inputted from said second block to said second standby circuit.

6. A liquid crystal display device of claim 5, wherein a standby starting signal is inputted from said first block to said first standby circuit.

* * * * *